United States Patent [19]

Macklin

[11] 3,963,210

[45] June 15, 1976

[54] APPARATUS FOR SETTING ANCHOR BOLTS AND OTHER OBJECTS IN CONCRETE SLABS

[76] Inventor: Charles D. Macklin, 8911 Aldwick Drive, Dallas, Tex. 75238

[22] Filed: Mar. 5, 1975

[21] Appl. No.: 555,531

[52] U.S. Cl. ..... 249/210; 52/295; 249/91; 249/93

[51] Int. Cl.[2] ..... E04G 17/00

[58] Field of Search ..... 249/1, 10, 91, 93, 205, 249/207, 210; 264/35; 52/292, 294–296; 248/156, 163; 269/321 S, 321 W, 43

[56] References Cited

UNITED STATES PATENTS

| | | | |
|---|---|---|---|
| 1,585,254 | 5/1926 | Lund et al. | 52/698 |
| 1,728,164 | 9/1929 | Zureck | 52/295 |
| 3,630,474 | 12/1971 | Minor | 52/295 |

FOREIGN PATENTS OR APPLICATIONS

| | | | |
|---|---|---|---|
| 2,117,069 | 4/1972 | Germany | 52/698 |

*Primary Examiner*—Francis S. Husar
*Assistant Examiner*—John McQuade
*Attorney, Agent, or Firm*—Richards, Harris and Medlock

[57] ABSTRACT

Disclosed is a support for use in setting anchor bolts, and the like, in a monolithic poured concrete slab and the method of using the same. The support has a plate with a plurality of elongate legs extending from one side thereof. A wooden block is attached to the other side of the plate by nails extending through bores in the plate. A template is provided with a plurality of bores of a size to receive anchor bolt assemblies therein. The bores in the template have a spacial relationship according to the desired location of the anchor bolts in the slab. A central referencing hole is provided in the center of the template for releasably attaching the template to the upper surface of the wooden block during the installation procedure. To use the apparatus, the legs of the support are first embedded in the subsoil of the slab before the slab is cast. The upper surface of the block is leveled in position at a desired height. A nail is inserted in the wooden block at the theoretical center of the column. Concrete is poured in the area around the support. Next, the template is positioned with the referencing hole over the finishing nail and the anchor bolts are forced down into the concrete. The concrete is allowed to set and the template and wooden block are then removed leaving the anchor bolts in the correct position for attaching the column.

7 Claims, 6 Drawing Figures

APPARATUS FOR SETTING ANCHOR BOLTS AND OTHER OBJECTS IN CONCRETE SLABS

BACKGROUND AND SUMMARY OF THE INVENTION

The present invention relates to improvements in apparatus for setting anchor bolts, and the like, in a concrete slab.

In the construction industry, it is common to use threaded anchor bolts set in concrete slabs to attach the base plate of a column in position. These base plates have flanges with a particular hole pattern therein through which the anchor bolts extend. Lock nuts on the anchor bolts are positioned above and below the base plate and are used to provide a system for attaching the columns to the slab.

It is conventional to set these anchor bolts in concrete slabs by first pouring the concrete and then inserting the anchor bolts in the concrete. In the setting of these anchor bolts, it is important that the anchor bolts be properly located in the concrete so that the columns will be in the proper position and so that the bolts will mate with the hole pattern of the column base plate.

Therefore, a means for accurately positioning these anchor bolts in the slab with a minimal amount of labor and expense is highly desirable.

Therefore, according to one embodiment of the present invention, an improved supporting apparatus is provided. The apparatus has a rigid plate with a plurality of elongate legs extending from one side thereof. Bores are formed through the plates for attaching a wooden block to the other side of the plate by fasteners extending through the bores. The support is positioned in the area where the anchor bolts are to be set in the concrete. The legs of the support are embedded in the subgrade of the slab until the upper surface of the plate is flush with the level of the upper surface of the slab.

Thereafter, a template carrying a plurality of anchor bolts is positioned on and supported from the upper surface of the wooden block with the anchor bolts in their desired ultimate position. A finishing nail can be driven into the block through a referencing hole in the template. Thereafter, the template is removed and concrete is poured into the form and around the support. Before the concrete sets, the template is positioned with the nail extending through the referencing hole to return the template to the desired position with the anchor bolts inserted into the concrete. After the concrete has set, the template is removed and the wooden block is detached from the support, leaving a properly positioned set of anchor bolts for attaching a column in place upon the slab.

In accordance with another embodiment of the invention, a form is provided and is supported from the apparatus to form a depression in the slab around the anchor bolts.

BRIEF DESCRIPTION OF THE DRAWINGS

A more complete understanding of the advantages and objects of the present invention will become apparent from the following detailed description when considered in connection with the accompanying Drawings in which.

DESCRIPTION OF THE PREFERRED EMBODIMENTS

Figure 1:
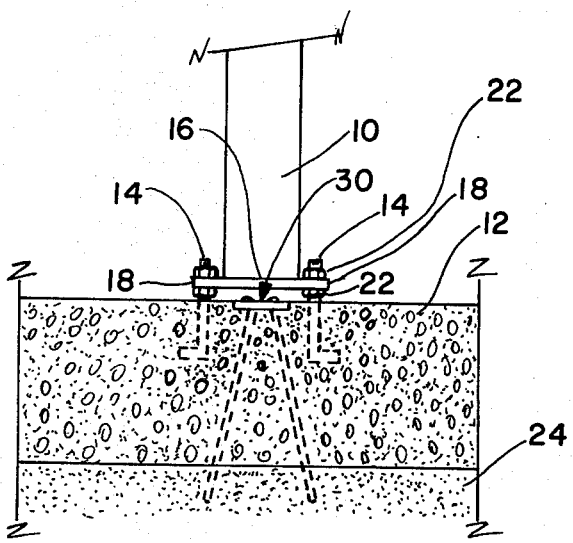
FIG. 1 illustrates a side elevation partly in section of an interior column attached to a slab by anchor bolts installed in accordance with the teachings of the present invention.

Referring now to the Drawings wherein like reference characters designate like or corresponding parts throughout the several views, there is illustrated in FIG. 1 an interior column 10 connected to a slab 12 by means of anchor bolt assemblies 14. As is illustrated, the column 10 has a conventional base plate 16 attached to the bottom thereof with flanges 18 extending to the sides of the column 10. Bores are provided in the flanges 18 for receiving the anchor bolt assemblies 14 therethrough. The anchor bolt assemblies 14 each comprises an L shaped anchor bolt 20 having threads on one end thereof with upper and lower lock nuts 22 engaging the threads.

The column 10 is attached to the slab 12 by inserting the bores in plate 16 over the ends of the bolts 20 to abut lower lock nuts 22 and thereafter, threading upper lock nuts 22 on top of the plate. The lower and upper lock nuts 22 can then be adjusted to level and position the column 10 as desired. The improved support assembly 30 of the present invention is illustrated in FIG. 1 cast in slab 12.

Figure 2:
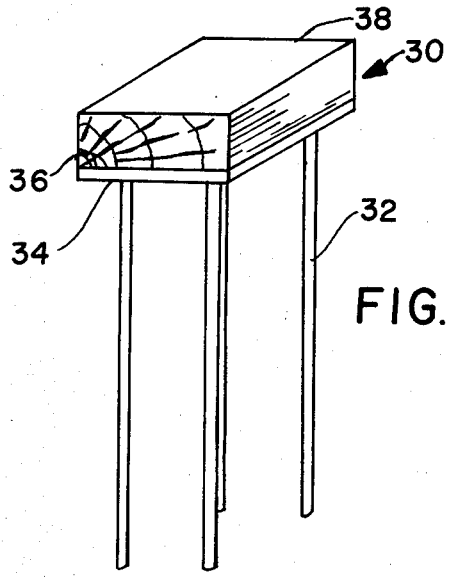
FIG. 2 is a perspective view of the support apparatus with a wooden block mounted thereon.

The improved support assembly 30 of the present invention is illustrated in detail in FIG. 2. As can be seen, the assembly 30 has a plate 34 with a plurality of legs 32 extending from one side thereof. The plate 34 has an upper surface 36 on which is mounted a pierceable block 38 of suitable material, such as wood. Block 38 of the present embodiment is wood and is removably attached to the plate 34 by nails 39 which extend through bores in the plate 34 from the side on which the legs 32 extend. In the preferred embodiment, the plate is one-eighth inch thick and 3½ × 3½ inches square. The legs are ⅜ inch bars and are welded to one side of the plate 34 to extend transversely therefrom. In the preferred embodiment, four legs are provided, but it is to be understood that more or less legs could be provided as required. In the normal position, the legs extend transverse to the plate 34, but during the installation of the support 30 in the subsoil 24, the legs can be bent outward, as illustrated in FIG. 2 to add stability to the support.

Figure 3:
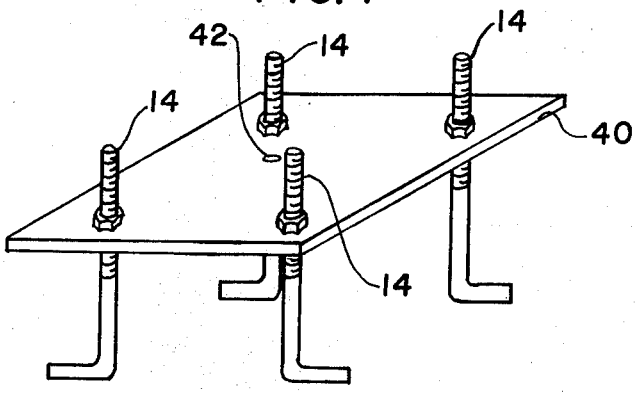
FIG. 3 is a perspective view of an anchor bolt template.

In FIG. 3, a template 40 is shown for use with the support assembly 30 in positioning the anchor bolt assemblies 14 in the concrete. The template can be constructed from any suitable material and is provided with four spaced bores for receiving the anchor bolt assemblies 14 therein. The bores in the template 40 are spaced the desired spacial locations of the bores in the base plate. The bolts are locked into the bores by means of the lock nuts 22, as illustrated in FIG. 3. A central referencing hole 42 is provided, as will be hereinafter described.

Figure 4:
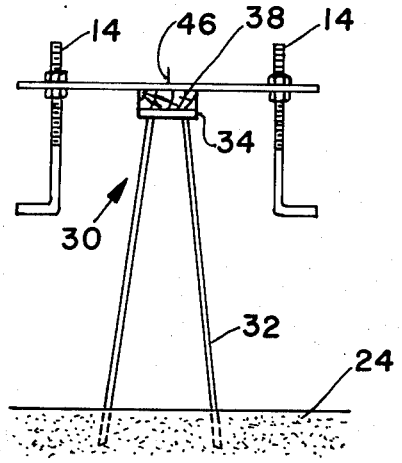
FIG. 4 illustrates one of the steps of using the support of the present invention with the legs of the support inserted in the subgrade and the template positioned thereon in the desired position.

The process of setting the anchor bolt assemblies 14 in the slab 12 by use of the present invention is as follows: First, the support 30 is assembled by attaching block 38 to the plate 34 by nails 39. The legs 32 are then bent diagonally outward as required. Next, the support 30 is located at the approximate center point of the column footing and the legs 32 are pushed into the subsoil 24 until a surface 36 of plate 34 is at the screed elevation of the slab 12 to be poured. The upper surface of the block 38 is leveled and the center line of the column is then located. This center line can be located by drawing center line strings from the perimeter forms and inserting a small finish nail 46 into the block 38 as shown in FIG. 4.

Next, the anchor bolts 14 are assembled in the template 40 as shown in FIG. 3. The concrete is poured and screed to the level of surface 36. While the concrete is wet, the template 40 is inserted with the referencing hole 42 on the nail 46 in the manner illustrated in FIG. 4. The anchor bolts are pushed into the wet concrete until the template lies flush on the upper surface of the block 38. The template is then rotated about the finish nail 46 as required to line up the center line of the template with the column center line strings. The apparatus is then left undisturbed until the concrete is set.

Figure 5:
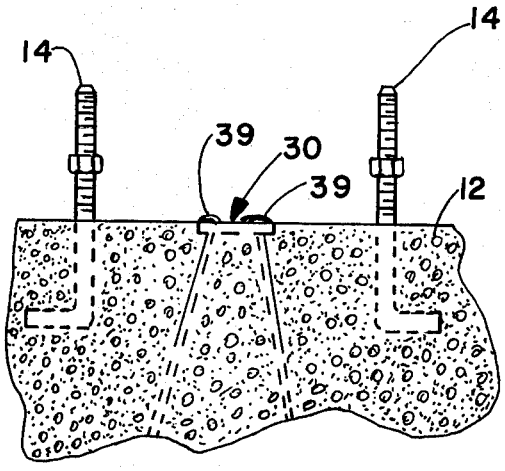
FIG. 5 illustrates a completed installation of the anchor bolts with the template removed and the support shown cast into the slab.

After the concrete has set, the upper lock nuts 22 are removed and the template 40 is slipped off of the upper end of the bolts 20. The block 38 can be removed. The fasteners 39 extending up through plate 34 can be hammered down flat with the surface 36, as shown in FIG. 5. The area will appear, as is illustrated in FIG. 5, ready for column erection.

Figure 6:
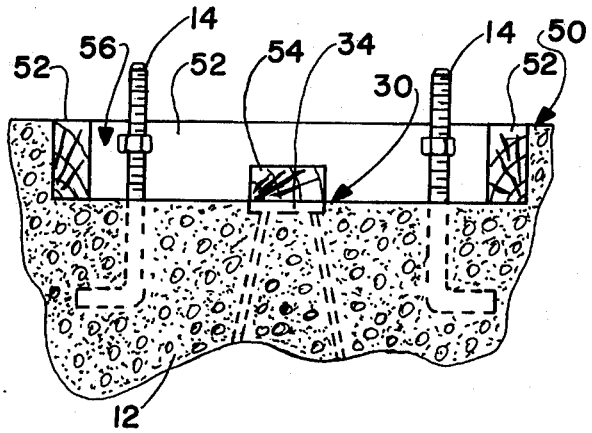
FIG. 6 illustrates an alternate embodiment of the present invention using a form with the support for performing a depression in the slab.

An alternate use of the improved support 30 of the present invention is illustrated in FIG. 6. In this Figure, the block 38 is eliminated and a small concrete form 50 is used in its place. This form 50 has four sidewalls 52 joined together at their ends and a member 54 attached to and extending between two sidewalls 52. The member 54 is attached to the plate 34 in the place of block 38. The process of installing the anchor bolts 14 is performed as described in FIGS. 4 and 5, except that the concrete is screed to the upper level of the sidewalls 52 with the interior of the form 50 causing a depression 56 in the concrete 12 which is screed to the level of the upper surface of the plate 34. This provides a recessed column footing.

It is to be understood that the process could be practiced by mounting the template on the support and pouring the concrete around the support and anchor bolts.

In addition, the support of the present invention could be used for other types of blocking and screeding in monolithic slab on grade construction, such as, continuous blocking to drop the slab level and the like.

Thus, the present invention describes an improved apparatus for use in quickly and accurately installing anchor bolts for interior slab structures. It is to be understood, of course, that the present invention could be altered by those of ordinary skill in the art without departing from the spirit and scope of the invention as defined in the appended claims.

What is claimed is:

1. An apparatus for use in setting anchor bolts in concrete, said apparatus comprising a support having a rigid plate, elongate legs extending transversely from one side of said plate for supporting said plate at an elevated position within a concrete form, a pierceable block releasably attached to said plate, a template releasably carrying a plurality of anchor bolts held in a predetermined spacial relationship, and means on said template for releasably attaching said template to said pierceable block whereby said anchor bolts are supported in a predetermined relationship in said form during the pouring of said concrete.

2. The apparatus of claim 1 wherein said pierceable block is formed from wood.

3. An apparatus as defined in claim 1 wherein said rigid plate has openings extending therethrough and wherein fasteners extend through said openings from said one side to engage said pierceable block to releasably attach said pierceable block to said plate.

4. The apparatus of claim 1 wherein at least three elongate legs extend from said plate and wherein said legs are of sufficient length to support said template at the desired height.

5. The apparatus of claim 1 wherein the means for releasably attaching said template comprises an opening in said template and a pin mounted in said block and extending through said opening.

6. The apparatus of claim 1 wherein said pierceable block comprises an elongate wooden member connected at its center to said plate and a form supported from said elongate member whereby a depression can be formed in said concrete.

7. An apparatus for use in setting objects such as anchor bolts and forms in concrete, said apparatus comprising a support having a rigid plate, elongate legs extending transversely from one side of said plate for supporting said plate at an elevated position within a concrete form, a pierceable block releasably attached to said plate, a template carrying said objects in a predetermined spacial relationship, and means on said template for releasably attaching said template to said pierceable block whereby said objects are supported in a predetermined relationship in said form during the pouring of said concrete.

* * * * *